US005137483A

United States Patent [19]

Nealy

[11] Patent Number: 5,137,483

[45] Date of Patent: Aug. 11, 1992

[54] DEVICE FOR CONNECTING A CORD TO A BODY BOARD OR THE LIKE

[76] Inventor: Robert B. Nealy, P.O. Box 3154, San Clemente, Calif. 92672

[21] Appl. No.: 805,850

[22] Filed: Dec. 10, 1991

[51] Int. Cl.[5] ..... A63C 15/06

[52] U.S. Cl. ..... 441/75; 441/74; 24/104; 24/105

[58] Field of Search ..... 114/218, 230, 369, 381, 114/244; 441/65, 74, 75; 24/104, 105, 115 R; 272/1 B; 410/96, 97, 101, 109, 112, 113, 115, 120; 294/86.1, 86.11; 248/494

[56] References Cited

U.S. PATENT DOCUMENTS

| | | | |
|---|---|---|---|
| 3,802,011 | 4/1974 | Castagnola | 441/75 |
| 4,041,562 | 8/1977 | Nealy | 441/75 |
| 4,044,415 | 8/1977 | Wood | 441/75 |
| 4,267,615 | 5/1981 | Nealy | 441/74 |
| 4,820,220 | 4/1989 | Fruzzetti | 441/74 |
| 5,026,088 | 6/1991 | Stuart | 441/74 |

*Primary Examiner*—Joseph F. Peters, Jr.
*Assistant Examiner*—Clifford T. Bartz
*Attorney, Agent, or Firm*—Plate, Strauss & Vanderburgh

[57] ABSTRACT

There is disclosed a connector consisting of a male coupler having a shank and head member and a female coupler including a cylindrical member having a bore and being open at one end for receiving the shank of the male coupling member. The female coupler is also provided with a head member affixed to the cylindrical member at the end opposite the open end. Both head members define a flat outer and inner face. The shank of the male coupler is preferably threaded for engaging corresponding mating threads or for self-tapping threads in the bore of the female coupler for retaining the shank in the bore. The female coupler, which is normally positioned at the upper surface of the surfboard, is provided with a head member having an axially extending opening which communicates between the outer surface of the head member and the bore and a normally extending passage which communicates between the bore and the exterior of the cylindrical member. The leash is then attached by inserting an end through the axial passage and out through the normally extending passage around the cylindrical member and back through the normally extending passage and out through the axially extending passage to provide a loop which is wrapped around the exterior of the cylindrical member and which extends out through the axially extending opening in the head member. When drawn down in a locked position, the head member pulls the loop down into the material of the board so that the outer surface of the head member is in essentially the same plane as the upper surface of the surfboard and the leash extends away from the board through the axially extending passage.

6 Claims, 2 Drawing Sheets

DEVICE FOR CONNECTING A CORD TO A BODY BOARD OR THE LIKE

FIELD OF THE INVENTION

This invention relates to devices for connecting cords to an object and more particularly to a device for connecting a cord to a body board or the like.

BACKGROUND OF THE INVENTION

Body boards are very popular for wave riding or floating where the rider lays or sits on the body board. A typical body board includes a panel of foam plastic which may be somewhat resilient and flexible. It is common practice to utilize a leash which is connected to the leg or ankle of the rider and the body board. The purpose of the leash is to prevent the rider from losing the body board in the event of a fall. Connectors or "leash anchors" have been developed which are adapted to secure the leash cord to a body board. One such leash anchor is disclosed in U.S. Pat. No. 4,267,615, Robert B. Nealy, granted May, 1981. In this device it can be seen that there is a passage in the upper head of the connector through which the cord is run and looped back on itself to provide connection between the cord and the body board. Such a configuration, however, is hard to manufacture and, for that reason, a more common design, illustrated in the FIG. 6, includes a raised tab on the head of the connector which is provided with a hole through which one end of the leash cord is inserted and tied back on itself. Such a head design, although well suited for connecting the leash to the body board, is undesirable in that leash connector extends above the upper surface of the body board which can result in discomfort and even injury. Desirably, the leash connector should not extend above the upper surface of the body board.

SUMMARY OF THE INVENTION

It is an object of the present invention to provide an improved connector for attaching a cord or leash to a body board which presents an essentially flat upper surface and does not extend above the upper surface of the body board.

Another object of the present invention is to provide a connector for a cord or leash which provides a stronger anchor for the cord.

Yet another object of the present invention is to provide a connector for a cord which can be used on boards of varying thicknesses in which the means for attaching the cord to the connecting device does not interfere with the means for locking halves of the connector together.

In accordance with the present invention there is provided a connector consisting of a male coupler having a shank and head member and a female coupler including a cylindrical member having a bore and being open at one end for receiving the shank of the male coupling member. The female coupler is also provided with a head member affixed to the cylindrical member at the end opposite the open end. Both head members define a flat outer and inner face. The shank of the male coupler is preferably threaded for engaging corresponding mating threads or for self-tapping threads in the bore of the female coupler for retaining the shank in the bore. With the shank threaded down into the bore of the female coupler, the respective head members are clamped tightly against the upper and lower surfaces of the board and are actually drawn inwardly toward each other to depress the material of the board under and immediately around the inner faces of the respective head members so that the outer surfaces of the head members are generally flush with the adjacent surface areas of the body board.

In accordance with the present invention the female coupler, which is normally positioned at the upper surface of the body board, is provided with a head member having an axially extending opening which communicates between the outer surface of the head member and the bore and a normally extending passage which communicates between the bore and the exterior of the cylindrical member. The leash is then attached by inserting an end through the axial passage and out through the normally extending passage around the cylindrical member and back through the normally extending passage and out through the axially extending passage to provide a loop which is wrapped around the exterior of the cylindrical member and which extends out through the axially extending opening in the head member. When drawn down in a locked position, the head member pulls the loop down into the material of the board so that the outer surface of the head member is in essentially the same plane as the upper surface of the body board and the leash extends away from the board through the axially extending passage.

In a preferred embodiment of the invention the axially extending passage is flared outwardly from the bore of the female coupler to the outer surface of the head member to permit the leash cord to lie flat as it exits the head member.

In the preferred mode, a loop is first made in the leash cord and the end of the loop is fed in through the axial passage and out through the normally extending passage and then brought down over the cylindrical member so that the leash cord encircles the cylindrical member and extends from the head member through the axial passage.

In yet another embodiment of the invention, a small through-running passage provides communication between the bore and the exterior of the cylindrical member at a point generally opposite that of the axially extending passage. The purpose of the through-running passage is to allow the insertion of a pin or similar device as an aid to guiding the end of the cord, or the loop, if need be, from the bore out through the normally extending passage.

Other advantages and features of the present invention will become apparent from the following detailed description taken in conjunction with the accompanying drawings.

DESCRIPTION OF THE PREFERRED EMBODIMENT

Figure 1:
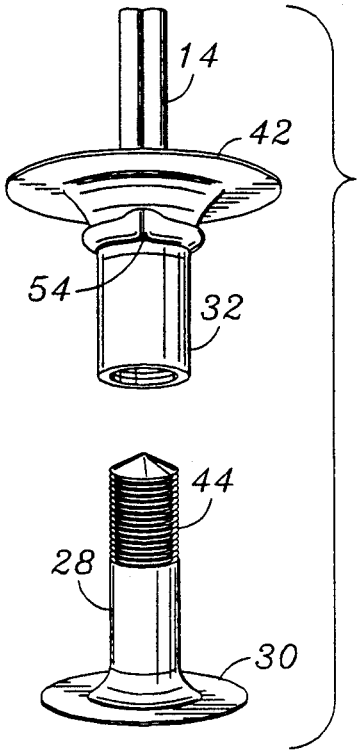
FIG. 1 is a perspective view of the male and female couplers and showing the leash cord attached to the female coupler in accordance with the present invention.

FIG. 1 shows a surf board 12, a leash 14 and a connector 16 for coupling one end of the leash 14 to the board 12. The board 12 is sufficiently buoyant to float in ocean water, and in the embodiment illustrated, it is constructed of a relatively resilient foam material 18 over which is normally provided a skin 20 of tougher abrasion resistant material. The board 12 has an upper surface 22 on which the rider normally lies or sits and a lower surface 24 which contacts the water.

As illustrated in FIGS. 1 through 4, the connector 16 comprises a male coupler 26 which includes a shank 28 and a head member 30 and a female coupler 32 which is provided with a cylindrical member 34 having a bore 36 open at one end 38 for receiving the shank 28 of the male coupler 26. The opposite end 40 of the cylindrical member 34 also carries a head member 42 adapted for the connection of the leash cord 14 as will be described below. Both of the head members 30 and 42 define an essentially flat outer face 48 and an essentially flat inner face 50. As illustrated, the shank 28 is provided with threads 44 which engage corresponding mating threads in the bore 36 of the cylindrical member 34 or, in the alternative, the shank 28 may be self-tapping and form its own corresponding threads as it is turned into the bore 36 of the cylindrical member 34. In the alternative, other means for locking the shank 28 in the bore 36 of the cylindrical member 34 may be employed. For example, the shank 28 may include a radial projection (not shown) adjacent its free end which is adapted to be received in a recess (not shown) within the bore 36 of the cylindrical member 34 such as disclosed in U.S. Pat. No. 4,267,615.

It is preferred, however, that the shank 28 of the male coupler 26 be threaded since it permits the use of the leash connector on boards 12 of varying thicknesses.

As shown more clearly in FIG's 2 through 4, the female coupler 32 includes an axial passage 46 which extends from the outer face 48 of the head member 42 into the bore 36 of the cylindrical member 34. Preferably, the axial passage 46 is enlarged at an area 52 adjacent the outer face 48 of the head member. A second passage 54 extends normally from the bore 36 and opens at 56 to the exterior of the cylindrical member 34.

The leash 14, which is commonly nylon cord or similar material, is introduced into the bore 36 of the cylindrical member 34 through the axial passage 46 and is turned perpendicularly to extend out through the second passage 54. In the preferred embodiment the passages are of sufficient size to permit a loop, pre-formed on the end of the leash 14, to be inserted into the bore 36 and out through the second passage 54 where it is then reversed back over the cylindrical member 34 in the manner shown in FIG. 1. In the alternative, however, the leash 14 may be used without the loop so that the end of the cord enters the axial passage 46 and exits through the second passage 54 where it is then turned around the exterior of the cylindrical member 34 and its end inserted back through the second passage 54 and out through the axial passage 46. The end of the leash 14 is then suitably affixed to the body of the leash 14. In either case, the leash 14 is connected to the female coupler 32 snugly around the exterior of the cylindrical member 34 and the cord extends away from the female coupler 32 through the axial passage 46.

Figure 3:
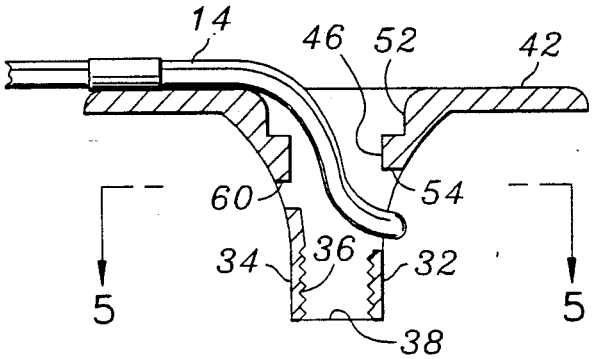
FIG. 3 is a side sectional view of the female coupler of FIG. 1.
Figure 2:
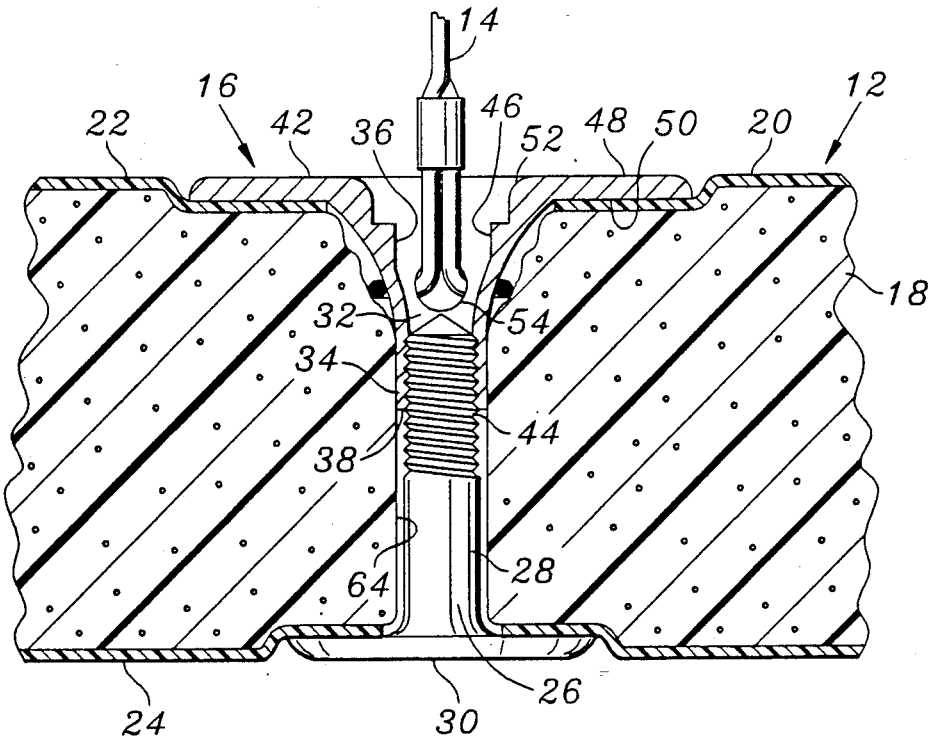
FIG. 2 is a sectional view of the male and female couplers of FIG. 1 as assembled on a board.
Figure 4:
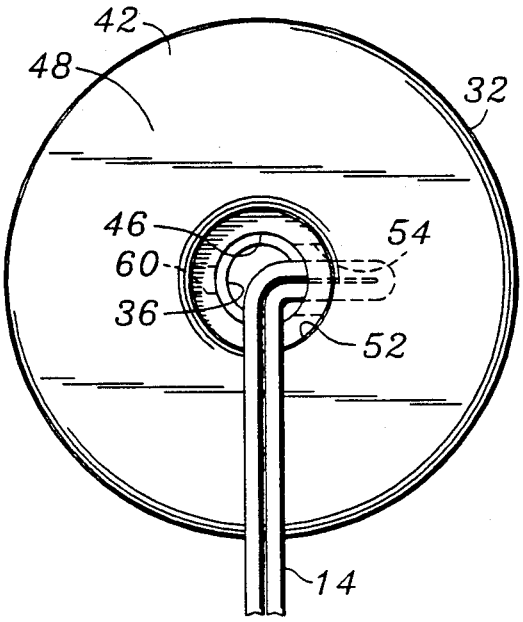
FIG. 4 is a top plan view of the female coupler of FIG. 1.
Figure 5:
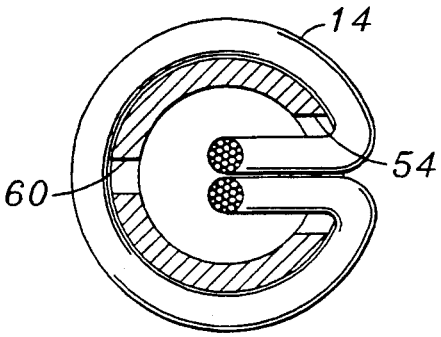
FIG. 5 is a top sectional view taken along line 5—5 of FIG. 3.
Figure 6:
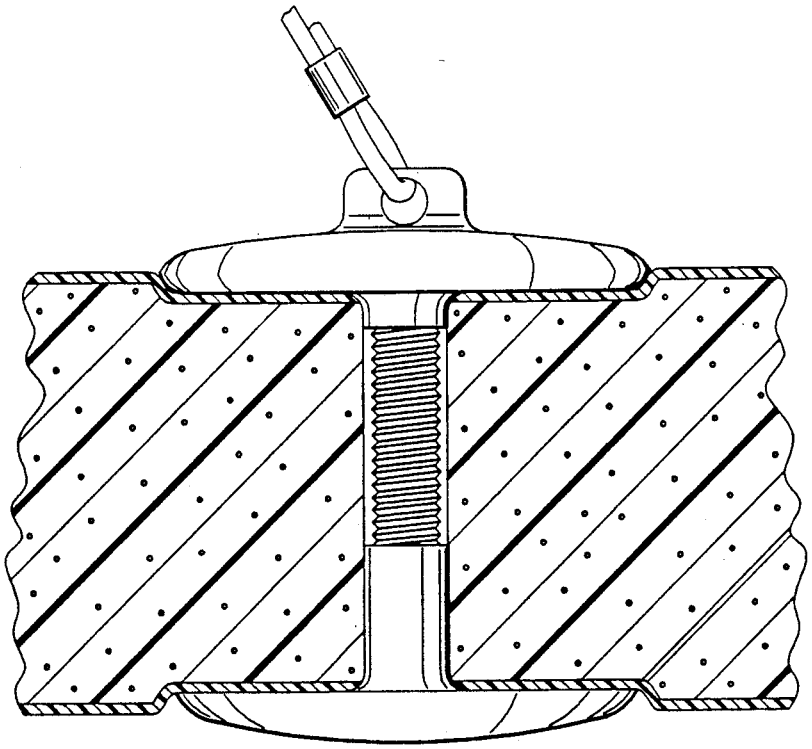
PRIOR ART FIG. 6
FIG. 6 is a sectional view of a leash connector of the prior art.

In the embodiment of the invention illustrated in FIG. 3, a third smaller passage 60 extends normal to the bore 36 of the cylindrical member 34 in a direction opposite that of the second passage 54 and opens to the exterior of the cylindrical member 34 at 62 on the side opposite the opening 56 of the second passage 54. This passage is sufficiently sized to permit insertion of a rod or similar device as a aid for guiding the end of the leash 14 or the loop formed in the leash 14 so that it will exit through the normally extending second passage 54.

As is conventional in the art, it is preferred that the male and female couplers, 36 and 42 respectively, be formed of a non-corrosive material, preferably a plastic material, such as nylon or polyurethane, which has sufficient strength to compress the surface of the board 12 when the couplers are drawn together.

To install the connector 16, a bore 64 is made in he upper surface 22 of the board to receive the end of the cylindrical member 34 of the female coupler. In view of the resilient nature of the board material, the diameter of the bore is not critical since the bore will expand around the cylindrical member 34. The bore 64 may be extended through the thickness of the board to serve as a guide for inserting the shank 28 of the male coupler 26. The shank 28 of the male coupler 26 is inserted in the bore 64 through the lower surface 24 of the board 12. The leash 14 is attached to the female coupler 32 by insertion through the axial passage 46 out the second passage 54 around the cylindrical member 34 and back out through the passages 54 and 46 in the manner already described. The cylindrical member 34 of the female coupler 32 is then inserted into the bore 64 at the upper surface 22 of the board 12 for receiving the end of the shank 28 of the male coupler 26. The two couplers are threaded together drawing the inner faces 50 of the head members, 30 and 42, together to compress the board 12 in the areas immediately adjacent the inner faces 50 of the head members, 30 and 42, so that their outer faces 48 lie essentially in the same plane as the respective surfaces of the board 12. The drawing together of the head members also causes the portion of the leash 14 surrounding the cylindrical member 34 of the female coupler 32 to enlarge the bore 64 and be forced down below the upper surface 22 of the board 12. Accordingly, that portion of the leash 14 does not interfere with the drawing in of the head member of the female coupler 32. The enlarged area of the axial passage permits the leash 14 to lie flat on the upper surface 22 of the board 12 so that it does not protrude or otherwise interfere with the operation of the board 12.

As previously mentioned, it is preferred that the shank 28 of the male member be threaded so that the connecting device can be used on boards 12 of varying thicknesses. On thinner boards 12 it is possible for the shank 28 to extend up into the axial passage 46 of the female coupler 32. The axial passage 46 is sufficiently large to allow for the leash 14 cord to be pushed aside by the end of the shank 28 and not be damaged by or otherwise interfere with the threading action of the shank 28 of the male connecting member.

As will be understood by those skilled in the art, various arrangements other than those described in detail in the specification will occur to those persons skilled in the art, which arrangements lie within the spirit and scope of the invention. It is therefor to be understood that the invention is to be limited only by the claims appended hereto.

Having described the invention, I claim:

1. In a connector for attaching a leash to a body board, said body board defining an upper and a lower surface, said connector consisting of a male and a female coupler adapted to be joined together, said male coupler including a shank member affixed to one end thereof, said shank projecting into said board and extending towards the upper surface of said board, said female coupler including a cylindrical member projecting into said board and extending towards the lower surface thereof, said cylindrical member having a bore and being open at one end for receiving the shank of said male coupling member, said female coupler having a head member affixed to said cylindrical member at an end opposite said open end, cooperating means carried by said male and said female coupler for drawing said coupler together and for securing said couplers together on said board, the improvement comprising:

said head member of said female coupler having an essentially planar outer and inner face so that as said male and female coupler are drawn together said inner face acts against the upper surface of said board to compress said upper surface in the area under and immediately adjacent said inner face of said head member causing said outer faces to lie essentially in the same plane as the upper surface of the board;

an axially extending opening communicating between said outer surface of said head member and said bore and a second normally extending passage communicating between said bore and the exterior of said cylindrical member;

said leash being attached to said female coupler through said axial passage and said normally extending second passage, around said cylindrical member and back through said second passage and said axially extending passage to provide a loop which is wrapped around the exterior of said cylindrical member and said leash extends out through the axially extending opening in the head member whereby said leash is securely attached to said board when said male and said female couplers are connected and the upper face of said head member of said female coupler lies in essentially the plane of the upper surface of said board.

2. The connector of claim 1 wherein said axially extending passage is flared outwardly from the bore of the female coupler to the outer face of said head member to define an enlarged area adjacent the outer face of said head member thereby to permit said leash to lie flat as it exits said axial passage.

3. The connector of claim 1 wherein a third passage extends in a direction opposite that of said second passage normal to said bore of said cylindrical member and opens on said cylindrical member opposite from the opening of said second passage.

4. The connector of claim 1 wherein said shank of said male coupler is threadably received in said cylindrical member of said female coupler thereby to draw said couplers together and to secure said couplers on said board.

5. The connector of claim 1 wherein said portion of said leash wrapped around the exterior of said cylindrical member is forced below said upper surface of said board responsive to the drawing together of said head-members of said male and said female coupler.

6. The connector of claim 1 wherein said axially extending opening is dimensioned to allow for a portion of said leash cord disposed therein to be pushed aside by the end of said shank of said male coupler as it enters said axially extending opening.

* * * * *